US006722913B2

(12) United States Patent
Saka et al.

(10) Patent No.: US 6,722,913 B2
(45) Date of Patent: Apr. 20, 2004

(54) CONNECTOR

(75) Inventors: Yukinori Saka, Yokkaichi (JP); Koji Okutani, Yokkaichi (JP); Atsushi Yamaoka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/223,763

(22) Filed: Aug. 19, 2002

(65) Prior Publication Data

US 2003/0040211 A1 Feb. 27, 2003

(30) Foreign Application Priority Data

Aug. 22, 2001 (JP) ..... 2001-251460

(51) Int. Cl.[7] ..... H01R 13/627
(52) U.S. Cl. ..... 439/352; 439/489
(58) Field of Search ..... 439/352, 357, 439/358, 489, 488, 353

(56) References Cited

U.S. PATENT DOCUMENTS 6,019,629 A * 2/2000 Ito et al. ..... 439/489
6,095,843 A * 8/2000 Kaneko et al. ..... 439/352
6,102,726 A * 8/2000 Tsuji et al. ..... 439/352
6,109,956 A 8/2000 Kawase et al.
6,196,867 B1 3/2001 Kawase et al.
6,241,542 B1 6/2001 Nishide et al.
6,247,955 B1 * 6/2001 Yoshida et al. ..... 439/352
6,358,081 B1 * 3/2002 Saka et al. ..... 439/352
6,383,009 B2 * 5/2002 Kawase et al. ..... 439/352
6,527,578 B2 * 3/2003 Kashiyama et al. ..... 439/352
6,551,146 B2 * 4/2003 Nakamura ..... 439/752

FOREIGN PATENT DOCUMENTS

EP 1 049 213 11/2000
JP 10-234005 9/1998

* cited by examiner

*Primary Examiner*—Gary Paumen
*Assistant Examiner*—X. Chung-Trans
(74) *Attorney, Agent, or Firm*—Gerald E. Hespos; Anthony J. Casella

(57) ABSTRACT

A male housing (10) pushes the front ends of springs (50), and a pushing portion (13) at the front end of the male housing (10) is more backward than the front ends of the springs (50), and front end portions of the springs (50) and a front end of the male housing (10) overlap. Thus, a connector can be made smaller by an overlapping length of the springs (50) and the male housing (10).

12 Claims, 11 Drawing Sheets

CONNECTOR

BACKGROUND OF THE INVENTION

1. Field of the Invention

The invention relates to a connector with a partial connection detecting function.

2. Description of the Related Art

U.S. Pat. No. 6,109,956 and U.S. Pat. No. 6,196,867 disclose a connector with a partial connection detecting function. This connector has first and second connectable housings and a biasing spring in the second housing. The rear end of the biasing spring is fixed in the second housing and the first housing pushes the front end of the biasing spring back during connection. Thus, the spring is compressed resiliently and accumulates a biasing force.

The rear end of the spring is allowed to move back when the housings reach a properly connected state and the spring is restored resiliently to extend back. As a result, the biasing force in the spring is released.

The biasing spring is restored resiliently forward if a connecting operation is interrupted prematurely. Thus, the biasing forces in the spring push the first housing back, and the housings are separated forcibly from each other. The connected state of the housings can be detected by the forcible separation.

The front end of the first housing contacts and pushes the front end of the biasing spring. The first housing and the extended biasing spring are arranged one after another when the housings are connected properly. Therefore, the connector is large along a connecting direction of the housings.

In view of the above, an object of the present invention is to make a connector smaller.

SUMMARY OF THE INVENTION

The invention is directed to a connector with at least first and second housings that are connectable with each other. A biasing means is provided in the second housing, and the first housing can push a front end of the biasing means back. A backward movement restricting means is provided for restricting backward movement of the rear end of the biasing means during connection of the housings. However, a restriction on the backward movement of the rear end of the biasing means is canceled when the housings are connected properly. A pushing means enables the first housing to push the front end of the biasing means Thus, the biasing means is compressed resiliently and accumulates a resilient restoring force during connection of the housings. The pushing means enables the front end of the first housing to be more backward than the front end of the biasing means in its pushing state.

The biasing means preferably is resiliently or elastically compressable and extendable substantially parallel to the connecting and separating directions of the housings.

The front end of the first housing is more backward than the front end of the biasing means when the first housing is pushing the front end of the biasing means. Thus, front end of the biasing means and the front end of the first housing overlap by a specified distance, and the connector is smaller than the above-described prior art connector by the specified overlapped distance.

The pushing means preferably comprises a front stop that contacts the front end of the biasing means when the pushing portion is at its front limit position. The pushing means also comprises a pushable portion that is more backward than the front stop and that can be engaged by the first housing.

The first housing contacts the pushable portion and pushes the pushing means, and the front stop of the pushing means pushes the front end of the biasing means. Thus, the first housing indirectly pushes the biasing means via the pushing means. A contact position of the pushing means with the biasing means and a contact position of the pushing means with the first housing are displaced in forward and backward directions. Accordingly, the displacement causes the biasing means and the first housing to overlap.

The front end of the first housing preferably contacts the pushing means. Accordingly, it is unnecessary to form a contact for the pushing means on the outer surface of the first housing, and the first housing can be simpler.

The backward movement restricting means preferably moves in sliding contact with portions of the second housing.

The backward movement restricting means may have projections that engage corresponding stoppers in the second housing to restrict loose movement.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
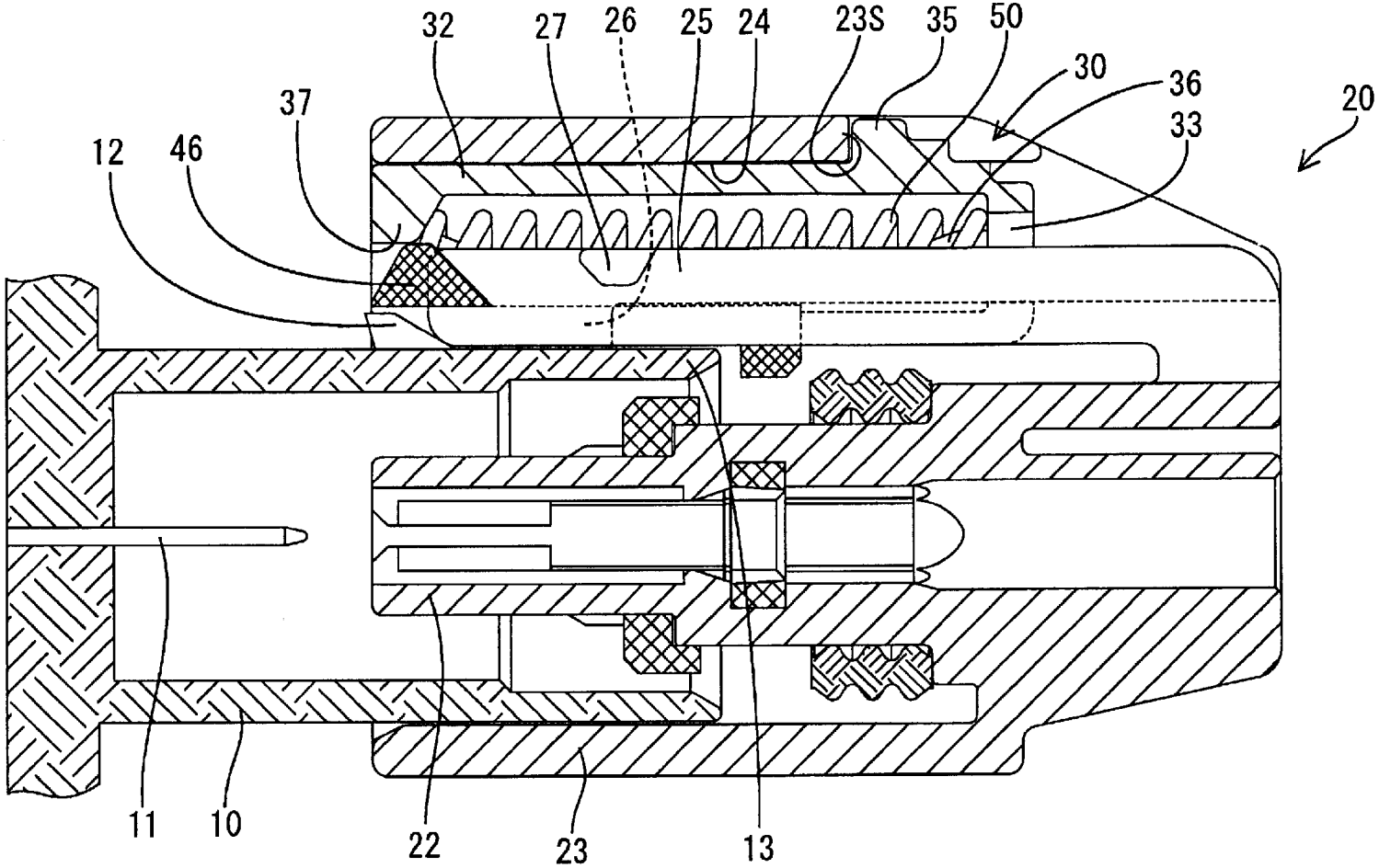
FIG. 1 is a section showing a disengaged state of male and female housings according to one embodiment of the invention.
Figure 2:
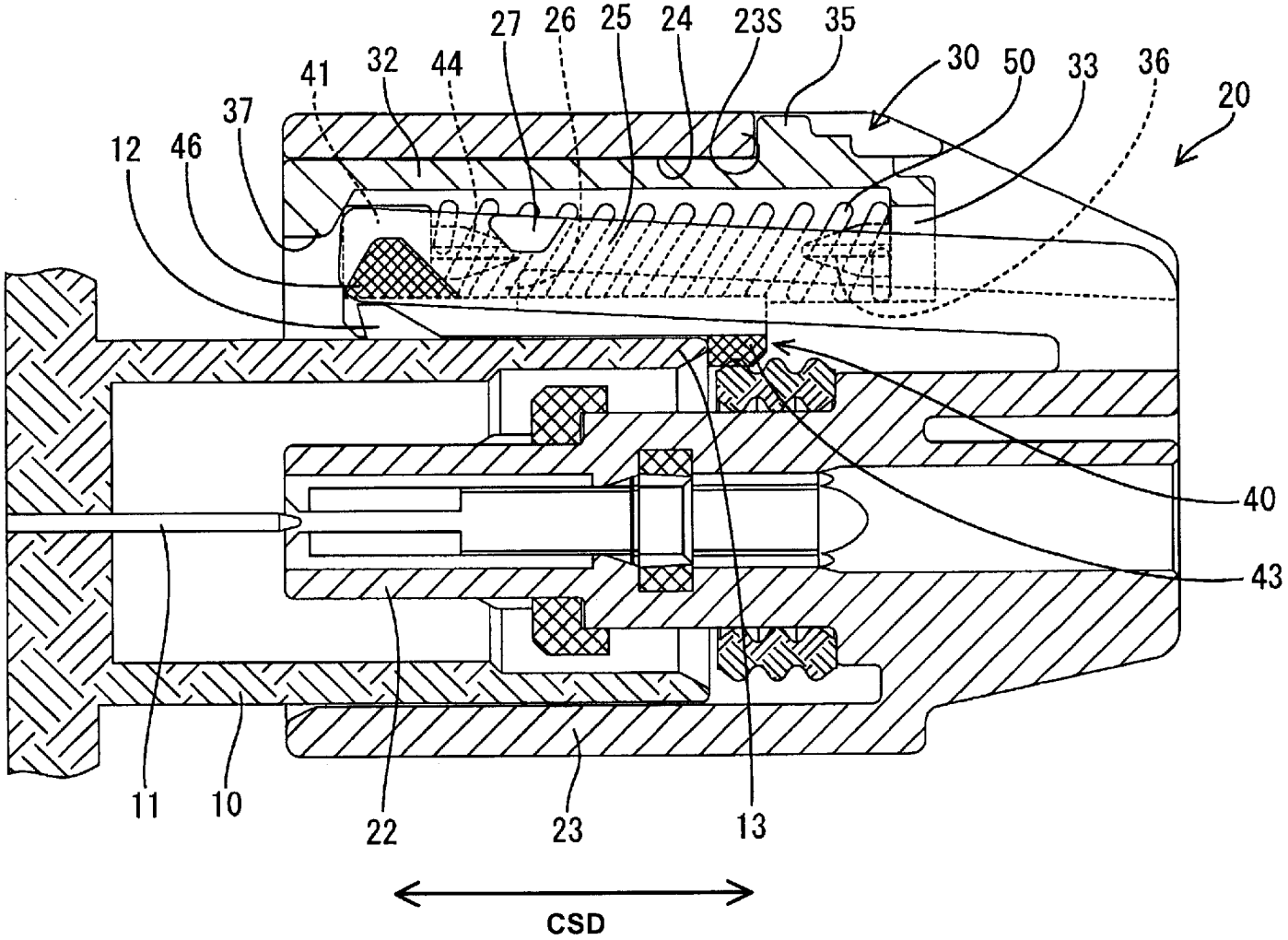
FIG. 2 is a section showing a connection process of the two housings.

A connector with a partial connection detecting function according to the invention is illustrated in FIGS. 1–5. The connector has a male housing 10 and a female housing 20 that are connectable with and separable from each other. In the following description, sides of the housings 10, 20 to be connected with each other are referred to as the front.

The male housing 10 may be coupled directly with electrical equipment, and is a forwardly open tube formed e.g. of a synthetic resin. Male terminal fittings 11 are disposed in the male housing 10, and a locking projection 12 with a slanted front surface is formed on the upper surface of the male housing 10.

The female housing 20 is formed e.g. of a synthetic resin and has a main body 22 that accommodates female terminal fittings 21 and a substantially tubular fitting 23 surrounding the main body 22. The upper wall of the tubular fitting 23 bulges up, and an operation space 24 is defined between the bulge and the upper surface of the main body 22.

A lock arm 25 cantilevers forwardly from the upper surface of the main body 22 and projects into the operation space 24. The lock arm 25 is resiliently displaceable about its rear end, and hence pivots up and down in the operation space 24 in a direction that intersects a connecting and separating direction CSD of the housings 10, 20. A locking claw 26 is formed on the bottom surface of the front end of the lock arm 25 for holding the housings 10, 20 locked together. Disengaging portions 27 project from opposite sides at the front end of the lock arm 25 and have slanted rear surfaces.

A slider 30 is provided in the operation space 24 to substantially surround the opposite lateral sides and the upper side of the lock arm 25. The slider 30 has left and right side walls 31, an upper wall 32 that connects the upper ends of the side walls 31, and left and right rear walls 33 that project in from the rear ends of the side walls 31. The side walls 31 have guide projections 34 that fit into guide grooves 28 in the inner side surfaces of the operation space 24. Thus, the slider 30 is movable forward and back substantially parallel with connecting and separating directions CSD of the housings 10, 20 while having its side walls 31 and upper wall 32 substantially in sliding contact with the inner surfaces of the operation space 24.

Loose forward and backward movements of the slider 30 are restricted by engaging the guide projections 34 with side stoppers 28S at the front ends of the guide grooves 28 from the front and engaging an operable projection 35 on the upper wall 32 with an upper stopper 23S of the tubular fitting 23 from behind. The guide projections 34 disengage from the side stoppers 28S and move freely in the guide grooves 28 if the slider 30 is pushed back with a specified force or larger.

The rear walls 33 of the slider 30 contact the rear ends of the springs 50 from behind to restrict backward movements of the rear ends of springs 50. Spring receiving projections 36 are formed on the front surfaces of the rear walls 33 for restricting loose transverse movements of the rear ends of the springs 50. A locking projection 37 is formed on the lower surface of the front end of the upper wall 32 of the slider 30 and engages the front end of the lock arm 25 during connection of the housings 10, 20 to restrict backward movement of the slider 30.

A pusher 40 has left and right front stops 41, left and right extensions 42 that extend back from the front stops 41, and a narrow plate-shaped pushable portion 43. The pushable portion 43 couples the rear ends of the extensions 42 and is rearward from the front stops 41. The front stops 41 contact the front ends of the springs 50 to stop them at their front limit positions and to restrict relative forward movements of the front ends of the springs 50. Spring receiving projections 44 are formed at the rear surfaces of the front stops 41 for restricting loose transverse movements of the front ends of the springs 50.

A pushing portion 13 at the upper front edge of the male housing 10 contacts the pushable portion 43 from the front, and pushes the pushable portion 43 during connection. The pusher 40 moves forward and back relative to the slider 30 in directions substantially parallel with the connecting and separating directions CSD of the housings 10, 20. Guide projections 45 on the outer side surfaces of the front stops 41 engage guide grooves 38 in the side walls 31 of the slider 30 to hold the front stops 41 substantially in sliding contact with the inner surface of the slider 30. The pusher 40 is at its front limit position when the guide projections 45 of the pusher 40 engage the front ends of the guide grooves 38 of the slider 30.

Unlocking portions 46 project in from the inner sides of the front stops 41 and have slanted front surfaces. The front stops 41 are at substantially opposite sides of the lock arm 25, and the disengaging portions 27 are at the same height as the unlocking portions 46. Thus, forward and backward movement of the pusher 40 causes the unlocking portions 46 to interfere with the disengaging portions 27 when the lock arm 25 is not resiliently deformed.

The springs 50 are compression coil springs arranged side by side with their longitudinal axes along forward and backward directions. The springs 50 are compressed slightly even when the pusher 40 is at the front limit position where the guide projections 45 engage the front ends of the guide grooves 38 of the slider 30. The springs 50 can be compressed resiliently between the rear walls 33 and the front stops 41 in response to relative movement in forward and backward directions between the slider 30 and the pusher 40.

The housings 10, 20 are connected by first fitting the male housing 10 slightly into the clearance between the main body 22 and the tubular fitting 23 of the female housing 20, as shown in FIG. 1. The locking claw 26 of the lock arm 25 then is brought into contact with the locking projection 12. At this stage, the slider 30 is at the front end of its movable range in forward and backward directions and loose forward and backward movement of the slider 30 is restricted. The pusher 40 also is at a most forward position with respect to the slider 30 and the springs 50 are most expanded. Further, the pushable portion 43 of the pusher 40 does not contact the pushing portion 13 at the front of the male housing 10, leaving a small clearance between the portions 13 and 43.

The female housing 20 then is pushed toward the male housing 10. As a result, the locking claw 26 moves onto the locking projection 12 and the lock arm 25 deforms up. The front end of the deformed lock arm 25 contacts the locking projection 37 of the slider 30 from behind and restricts backward movement of both the slider 30 and the rear ends of the springs 50. Further, the pushing portion 13 of the male housing 10 contacts the pushable portion 43 of the pusher 40, and moves the pusher 40 back with respect to both the slider 30 and the female housing 20 as connection proceeds. The front ends of the springs 50 move back together with the pusher 40. However, the slider 30 prevents the rear ends of the springs 50 from moving back. Accordingly, the springs 50 are compressed and accumulate resilient restoring forces.

If a connecting operation is interrupted halfway, the springs 50 are restored resiliently and extend forward due to the resilient restoring forces accumulated in the springs 50. As a result, the springs 50 urge the pusher 40 against the male housing 10, and the female housing 20 is separated from the male housing 10. This forcible separation of the two housings 10, 20 shows that they were left partly connected.

Figure 3:
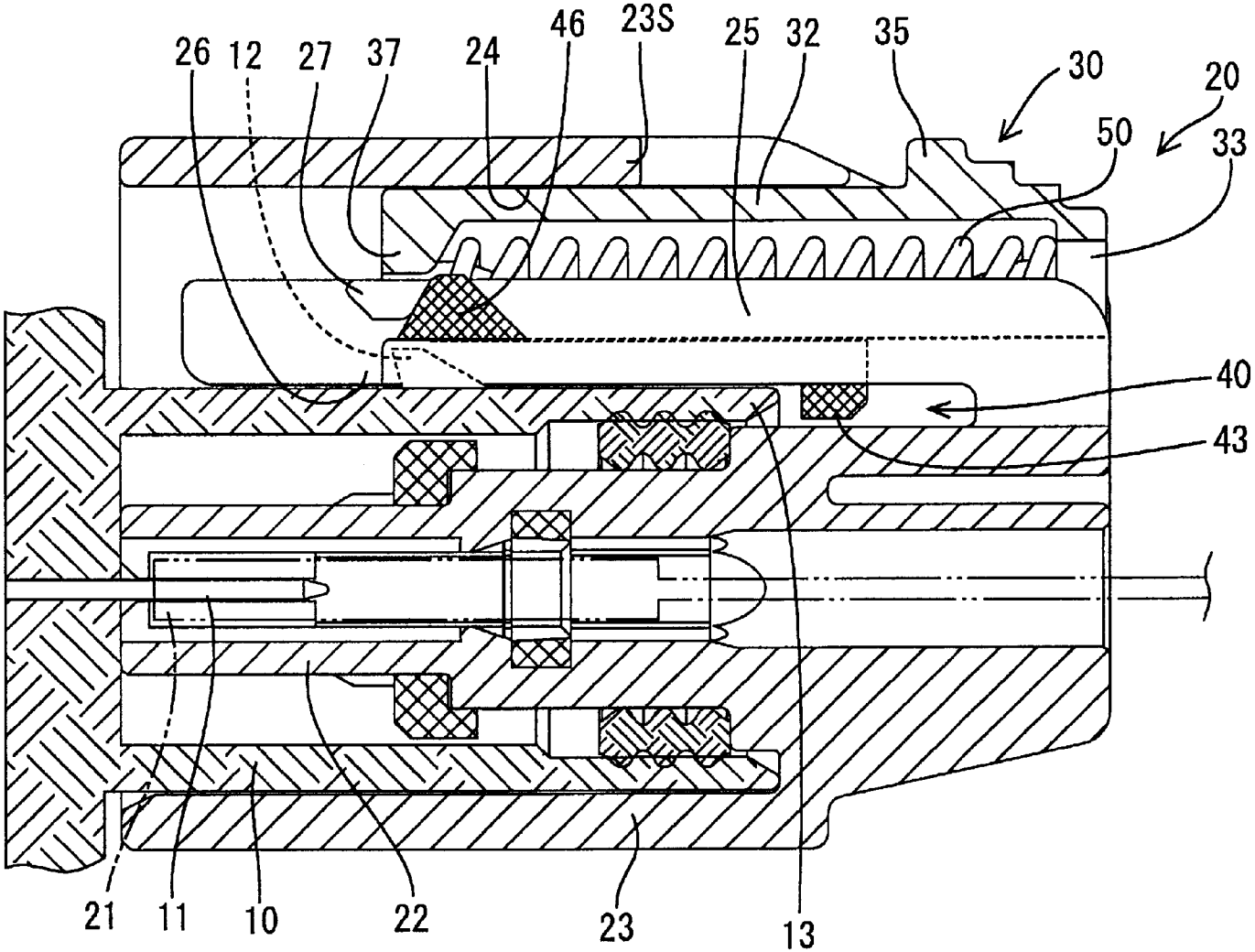
FIG. 3 is a section showing the two housings properly connected.

The locking claw 26 passes the locking projection 12 when the housings 10, 20 are connected properly. Thus, the lock arm 25 is restored due to its own resiliency and the locking claw 26 engages the locking projection 12 to lock the housings 10, 20 together, as shown in FIG. 3. The resiliently restored lock arm 25 is disengaged from the locking projection 37 of the slider 30. Thus, the resilient restoring forces accumulated in the springs 50 are released and drive both the slider 30 and the rear ends of the springs 50 back. As the springs 50 are extended, the guide projections 34 of the slider 30 disengage from the lateral stoppers 28S of the female housing 20 to move the slider 30 back. The locking projection 37 of the slider 30 then contacts the lock arm 25 and from above. Thus, an upward displacement of the lock arm 25 away from the locking projection 12 is restricted, and the housings 10, 20 are locked doubly.

Figure 4:
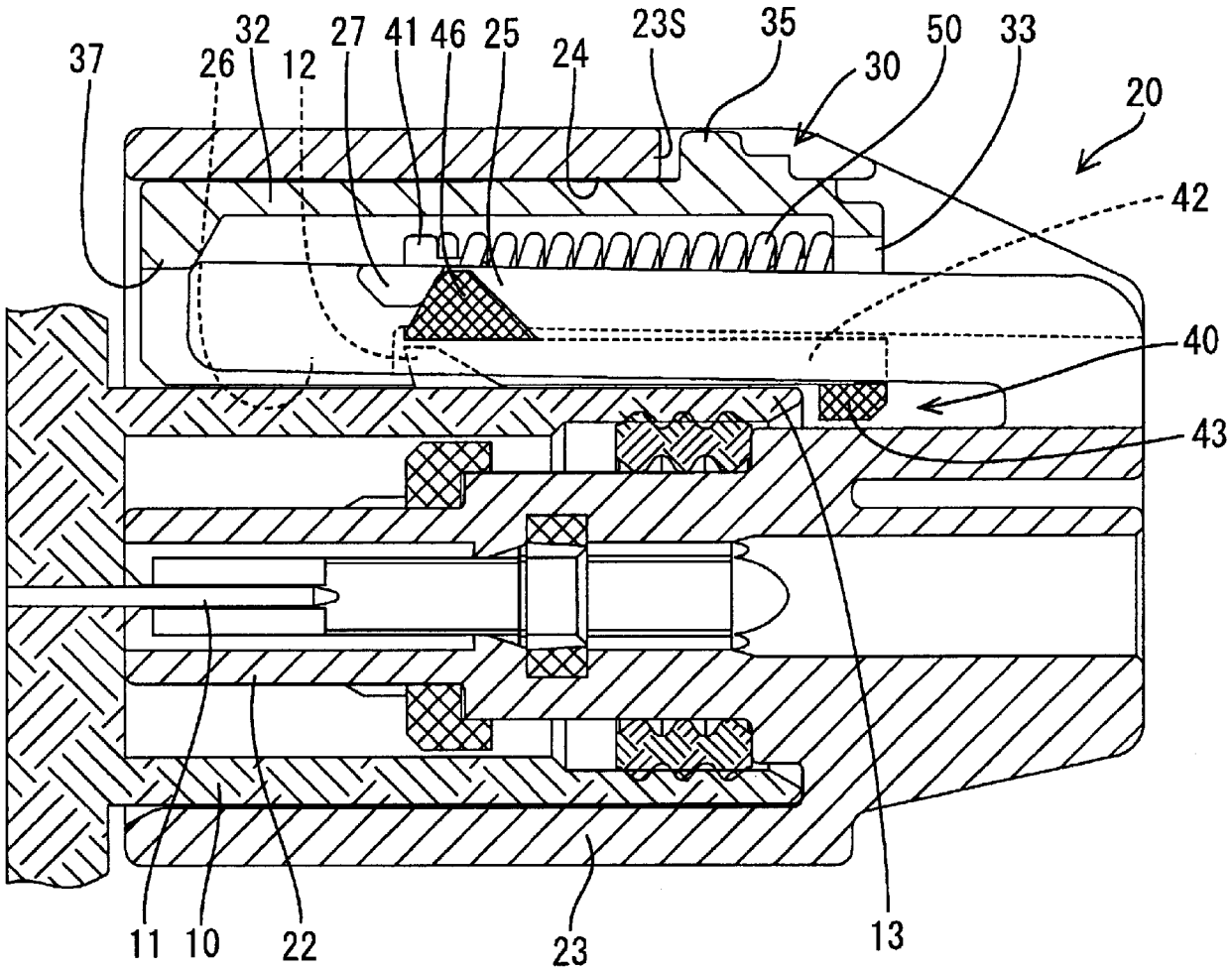
FIG. 4 is a section showing a state where the housings start separating.
Figure 5:
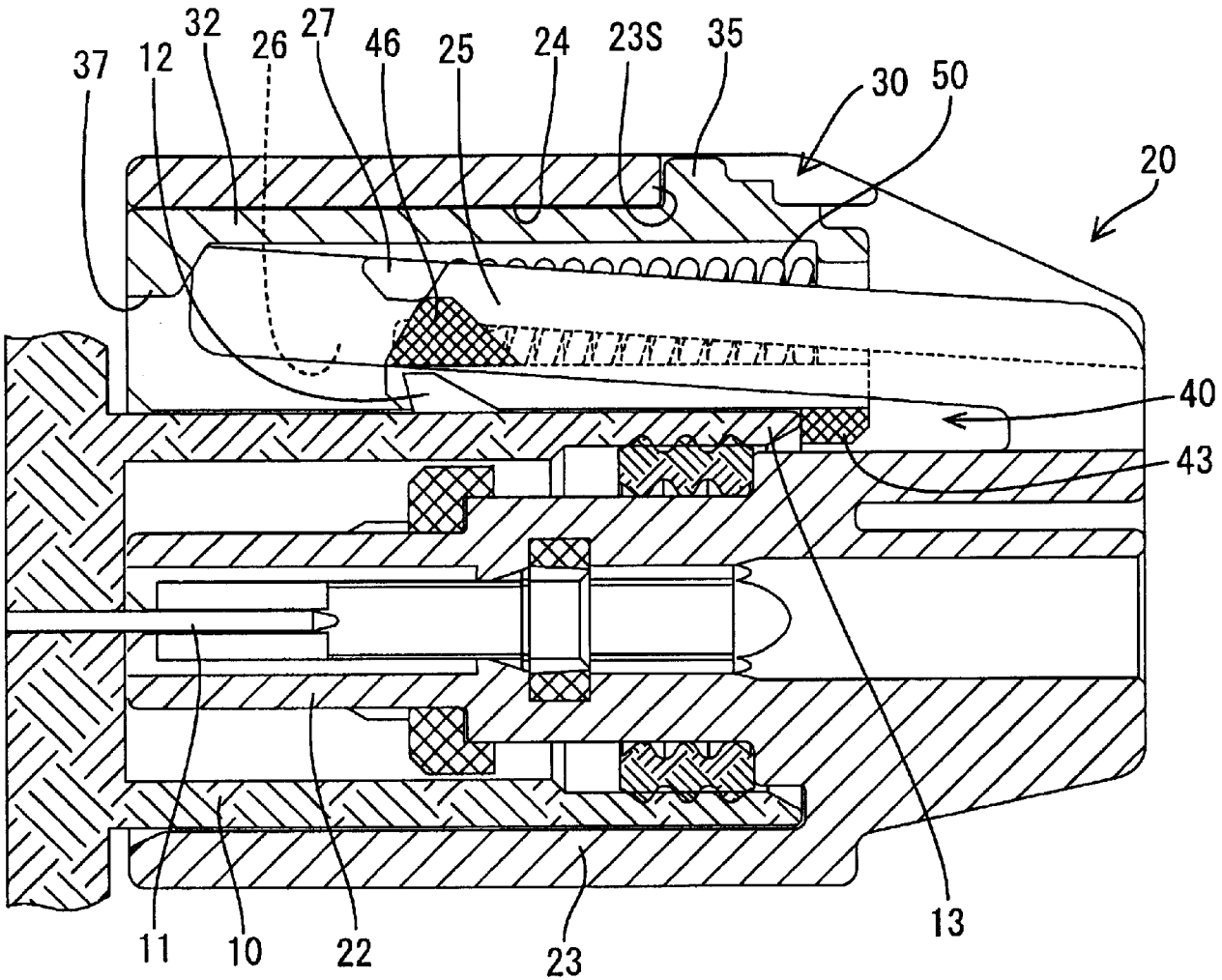
FIG. 5 is a section showing a separation process of the two housings.
Figure 6:
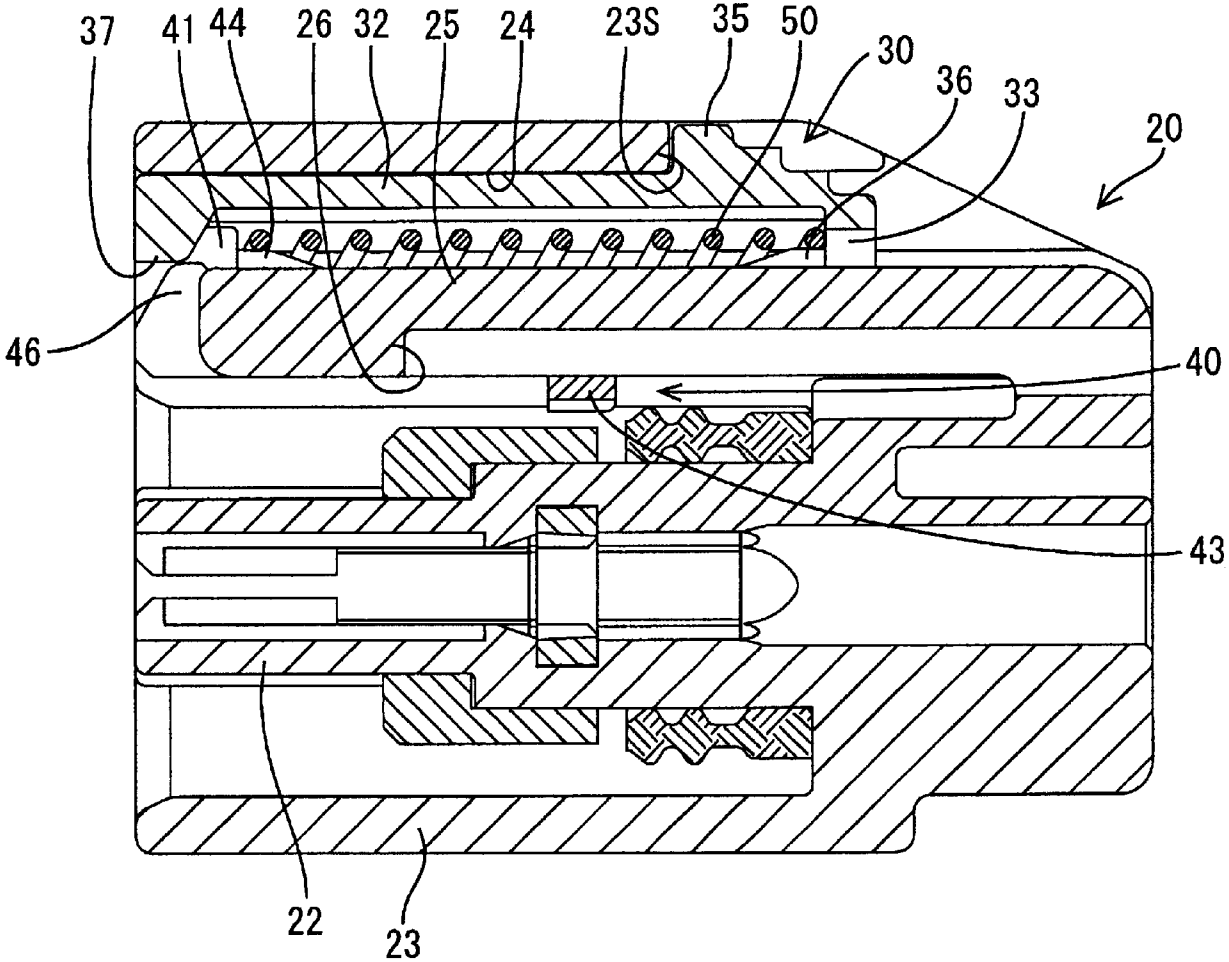
FIG. 6 is a section of the female housing.
Figure 7:
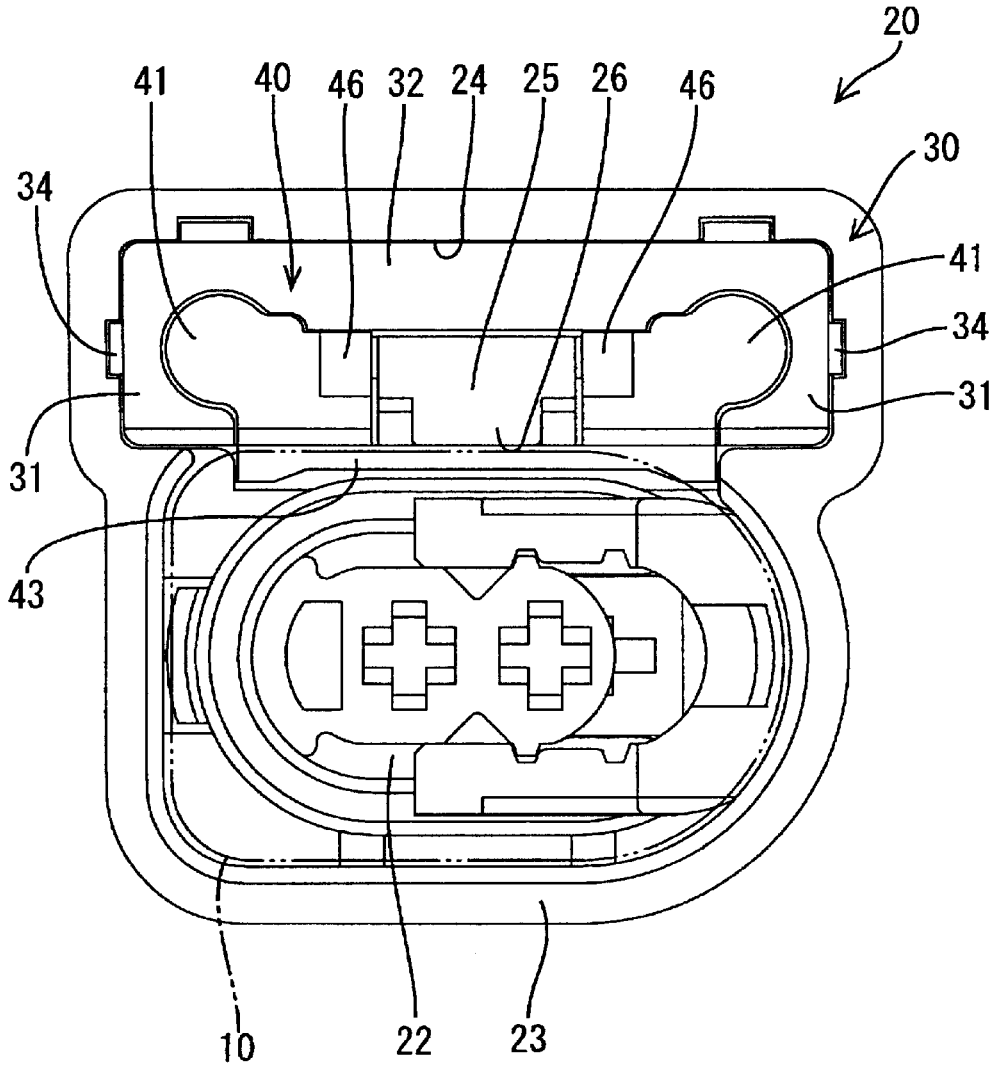
FIG. 7 is a front view of the female housing.
Figure 8:
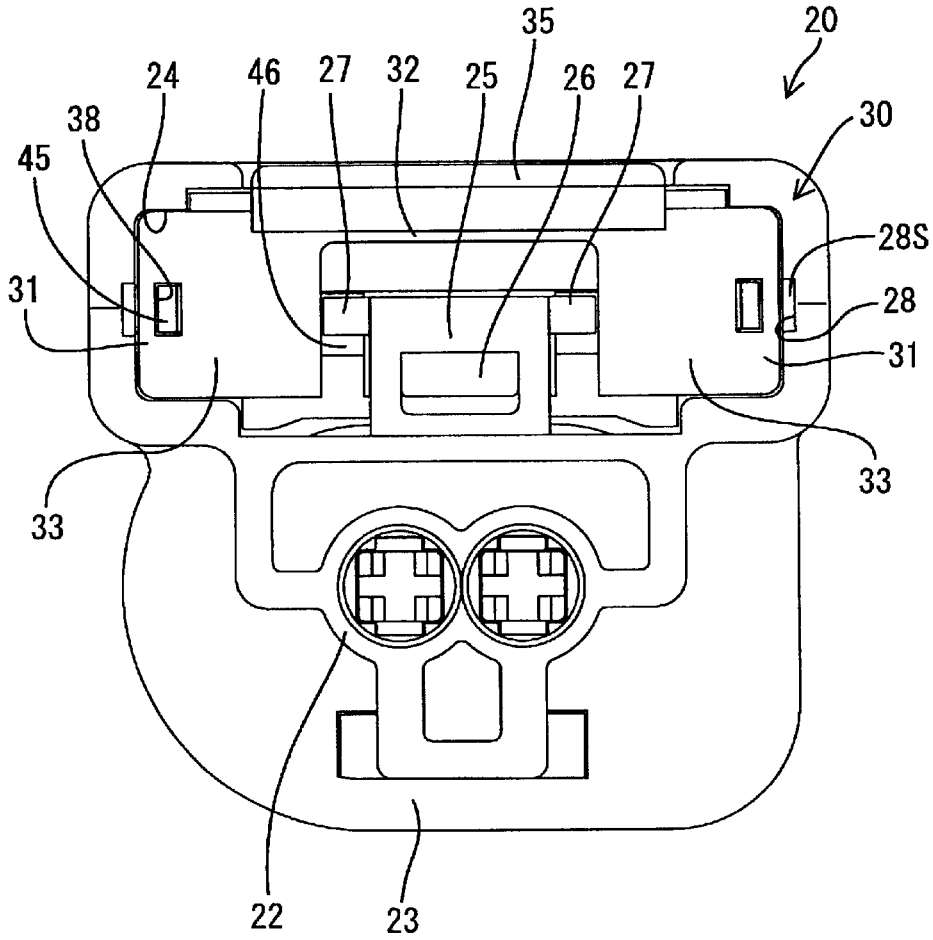
FIG. 8 is a rear view of the female housing.
Figure 9:
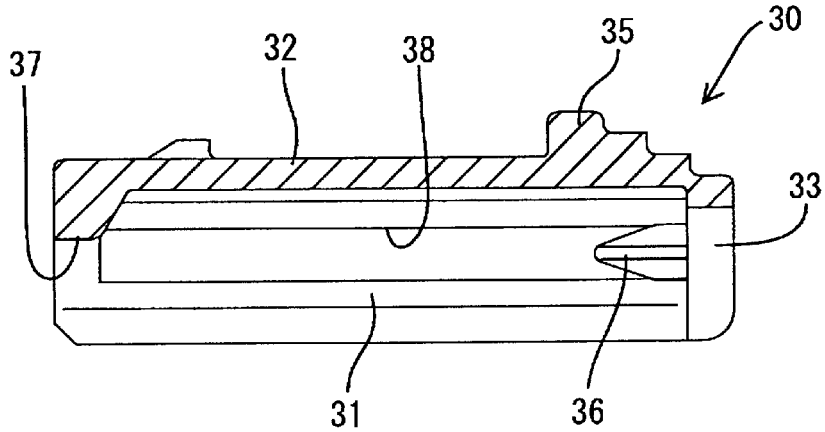
FIG. 9 is a section of a slider.
Figure 10:
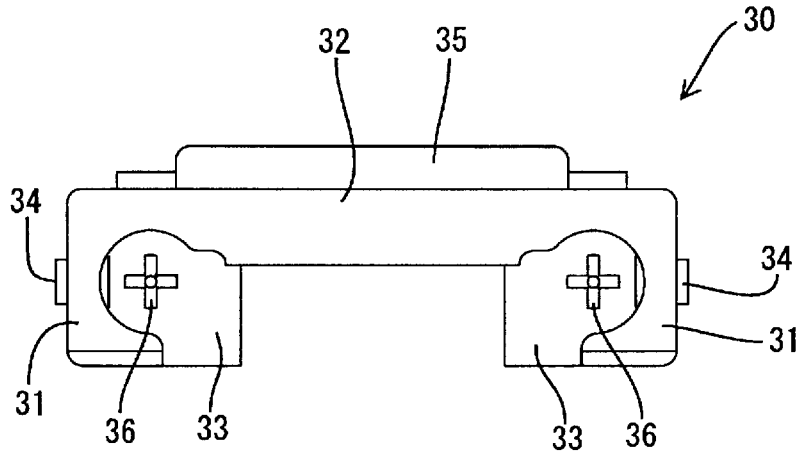
FIG. 10 is a front view of the slider.
Figure 11:
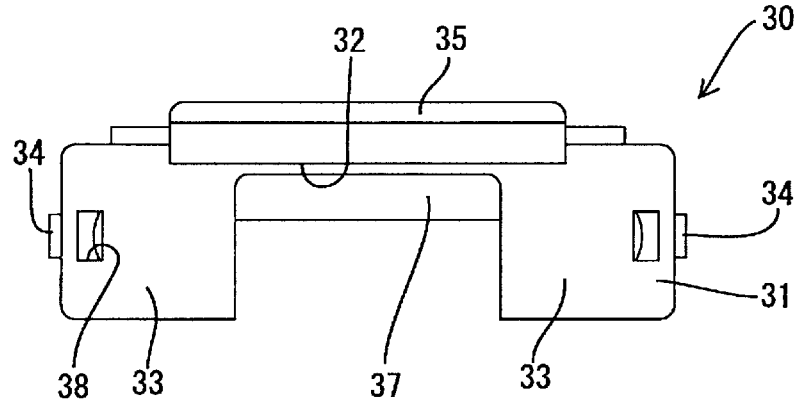
FIG. 11 is a rear view of the slider.
Figure 12:
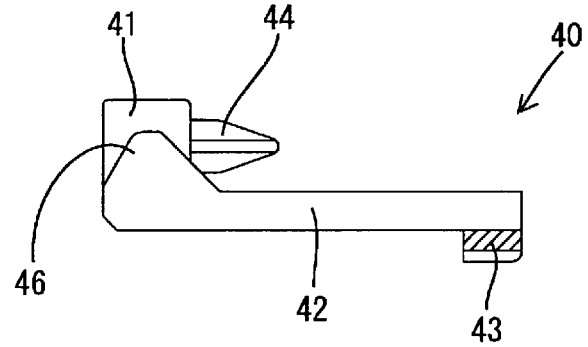
FIG. 12 is a section of a pushing member.
Figure 13:
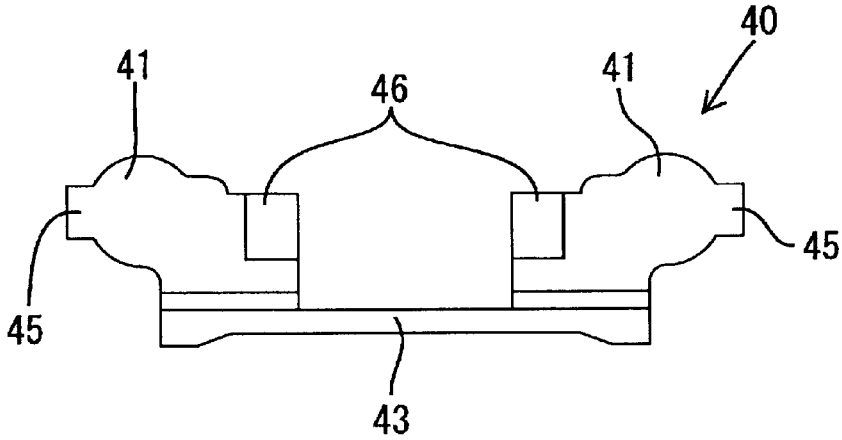
FIG. 13 is a front view of the pushing member.
Figure 14:
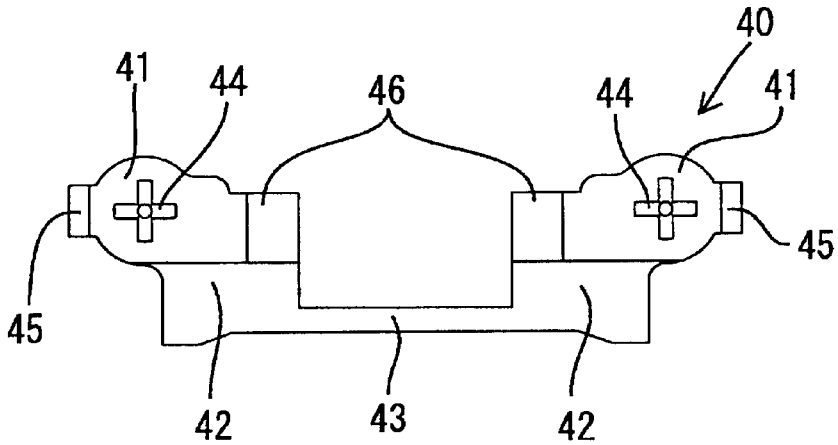
FIG. 14 is a rear view of the pushing member.
Figure 15:
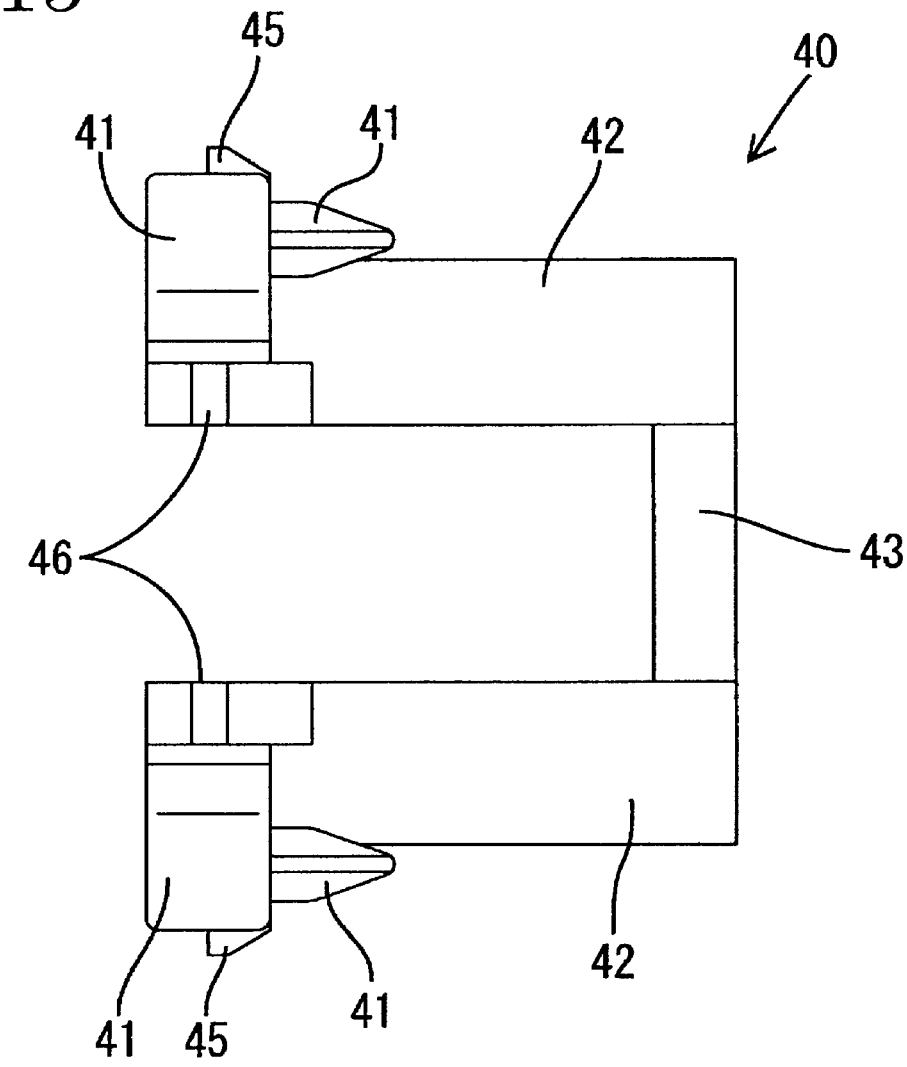
FIG. 15 is a plan view of the pushing member.

The properly connected housings 10, 20 are separated by placing a finger or jig on the operable projection 35 of the slider 30 in the state shown in FIG. 3 to move the slider 30 forward (see FIG. 4). The unlocking portions 46 of the pusher 40 then contact the disengaging portions 27 of the lock arm 25, and the pusher 40 and the front ends of the springs 50 do not move forward. Accordingly, the springs 50 are compressed as the slider 30 is moved forward. The locking projection 37 of the slider 30 moves forward from the lock arm 25 as the slider 30 is moved further to cancel the restriction on the upward displacement of the lock arm 25. Thus, the unlocking portions 46 of the pusher 40 are subjected to the resilient restoring forces accumulated in the springs 50 and push the disengaging portions 27 of the lock arm 25. The lock arm 25 is pushed up by the inclinations of the slanted surfaces of the portions 46 and 27, thereby unlocking the housings 10, 20. The disengaging portions 27 of the lock arm 25 are disengaged upward from the unlocking portions 46 of the pusher 40 by the upward displacement of the lock arm 25, as shown in FIG. 5. Consequently, forward movement of the pusher 40 is permitted and the pusher 40 and the front ends of the springs 50 are moved forward by the resilient restoring forces of the springs 50. Accordingly, the pushable portion 43 of the pusher 40 relatively pushes the pushing portion 13 of the male housing 10, with the result that the female housing 20 is separated from the male housing 10.

As described above, the pushing portion 13 at the front end of the male housing 10 is more backward than the front ends of the springs 50 (i.e. the pushable portion 43 of the pusher 40 is more backward than the front stops 41 of the pusher 40) while the male housing 10 is pushing the front ends of the springs 50. In other words, front ends of the springs 50 and the front end of the male housing 10 are placed one over the other. Thus, as compared to a prior art connector in which the male housing and the biasing springs are arranged one after another in forward and backward directions with their front ends held in contact, the female housing 20 can be made smaller by an overlapping length of the biasing springs 50 and the male housings 10, which leads to a smaller size of the entire connector.

The pusher 40 has the front stops 41 that contact the front ends of the springs 50 to stop them at their front limit positions and the pushable portion 43 located more backward than the front stops 41 and to be brought into contact with the male housing 10 is used as a pushing means. Accordingly, the male housing 10 pushes the pusher 40 by contacting the pushable portion 43, and the front stops 41 of the pusher 40 push the front ends of the springs 50. Thus, the male housing 10 indirectly pushes the springs 50 via the pusher 40. The springs 50 and the male housing 10 overlap by a displacement in forward and backward directions between a first contact position (front stops 41) of the pusher 40 with the springs 50 and a second contact position (pushable portion 43) thereof with the male housing 10 and, the female housing 20 can be made smaller by this displacement.

The pusher 40 contacts the front end of the male housing 10, and it is not necessary to form a contact portion with the pusher 40 on the outer surface of the male housing 10. In this way, the male housing 10 is simplified.

The invention is not limited to the above described and illustrated embodiment. For example, following embodiments are also embraced by the technical scope of the present invention as defined in the claims. Beside the following embodiments, various changes can be made without departing from the scope and spirit of the present invention as defined in the claims.

The front end of the second housing is more forward than the rear ends of the springs with the springs extended in the foregoing embodiment. However, it may be more backward than the rear ends of the springs with the springs extended according to the present invention.

Although the housing with the biasing springs is a female housing in the foregoing embodiment, it may be a male housing according to the invention.

Although the pusher contacts the front end of the second housing in the foregoing embodiment, it may contact a position of the second housing more backward than the front end according to the present invention.

Although springs are described as biasing means, other biasing means such as leaf springs, resilient rods or the like may be used.

What is claimed is:

1. A connector, comprising;

first and second housings having front ends that are connectable with each other;

a biasing means in the second housing, and having front and rear ends, the front end of the biasing means being pushable by the first housing during connection of the first and second housings such that the first housing pushes the front end of the biasing means back;

a backward movement restricting means for restricting a backward movement of the rear end of the biasing means during connection of the first and second housings and for permitting backward movement of the rear end of the biasing means when the housings are connected properly with each other, and a pushing means having at least one front stop for engaging the front end of the biasing means and a pushable portion rearward of the front stop and engageable by the front end of the first housing for enabling the pushing means to push the front end of the biasing means while the front end of the first housing is between the front and rear ends of the biasing means in its pushing state.

2. The connector of claim 1, wherein the biasing means is resiliently compressable and expandable in directions substantially parallel to connecting and separating directions of the housings.

3. The connector of claim 2, wherein the biasing means is compressed resiliently and accumulates a resilient restoring force during connection of the housings.

4. The connector of claim 2, wherein the biasing means is extended backward when the housings are connected properly.

5. The connector of claim 1, wherein the pushing means comprises:

a front stop disposed for contacting the front end of the biasing means to define a front limit position, and a pushable portion that is more backward than the front stop for contacting the first housing.

6. The connector of claim 1, wherein the pushing means is disposed for contacting a front end of the first connector housing.

7. The connector of claim 1, wherein the backward movement restricting means is movable in the second housing while being held substantially in sliding contact with portions thereof.

8. The connector of claim 7, wherein a loose movement of the backward movement restricting means is restricted by engaging at least one projection thereof with at least one stopper in the second housing.

9. A connector, comprising:

a first housing having a front end a second housing having front and rear ends and a main body dimensioned for connecting with the first housing, an operation space adjacent the main body, a resilently deflectable lock arm cantilevered forwardly in the operation space and configured for locked engagement with the first housing when the housings are connected properly;

a biasing means disposed in the operation space and having opposite front and rear ends;

a slider slideably disposed in the operation space and having a rear wall engaging the rear end of the biasing means; and a pusher slideably disposed in the operation space and having opposite front and rear ends, front stops in proximity to the front end of the pusher engaging the front end of the biasing means and a pushable portion in proximity to the rear end thereot the pushable portion disposed for contact by the front end of the first housing during connection, such that the first housing engages an area of the pusher rearwardly of the front end of the biasing means for enabling the pusher to compress the biasing means during connection of the housings.

10. The connector of claim 9, wherein the first housing has a locking projection disposed for engaging the lock arm of the second housing during connection of the housings and deflecting the lock arm into a position for restricting movement of the slider during connection.

11. The connector of claim 10, wherein the locking projection and the lock arm are configured for permitting the lock arm to return resiliently to an undeflected position and away from the slider when the housings are connected properly, such that the lock arm lockingly engages a locking projection on the first housing to lock the housings together and such that the biasing means propels the slider rewardly relative to the pusher and the second housing into a rearward position.

12. The connector of claim 11, wherein the slider in the rearward position is disposed substantially adjacent the lock arm for substantially preventing resilient deflection of the lock arm out of the looking engagement with the locking projection.

* * * * *